US007568325B2

(12) United States Patent
Monti

(10) Patent No.: US 7,568,325 B2
(45) Date of Patent: Aug. 4, 2009

(54) DEVICE FOR GRIPPING AND TRANSFERRING ARTICLES, IN PARTICULAR BOXES

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/873,612

(22) Filed: Oct. 17, 2007

(65) Prior Publication Data

US 2008/0098695 A1 May 1, 2008

(30) Foreign Application Priority Data

Oct. 25, 2006 (IT) ..... BO2006A0739

(51) Int. Cl.
*B65B 43/26* (2006.01)
*B31B 1/78* (2006.01)

(52) U.S. Cl. ..... 53/381.1; 53/458; 493/309

(58) Field of Classification Search ..... 53/381.1, 53/382.2, 382.3, 564, 566, 457, 458; 493/309, 493/310

See application file for complete search history.

(56) References Cited

U.S. PATENT DOCUMENTS 1,991,223 A * 2/1935 Ledig et al. ..... 221/293
2,358,292 A 9/1944 Mahliot
3,613,526 A * 10/1971 Jones ..... 493/313
3,613,527 A * 10/1971 Hentges et al. ..... 493/180
4,232,591 A * 11/1980 Karpinsky ..... 493/314
4,642,975 A * 2/1987 Langen et al. ..... 53/564
4,709,538 A * 12/1987 Olsen et al. ..... 53/566
4,891,928 A * 1/1990 James et al. ..... 53/250
5,517,798 A * 5/1996 Klopfenstein ..... 53/249
7,422,551 B2 * 9/2008 Monti ..... 493/309

FOREIGN PATENT DOCUMENTS

DE 1 511 643 8/1969
EP 0 359 538 A 3/1990
EP 1 215 144 A 6/2002
GB 910 633 A 11/1962

* cited by examiner

*Primary Examiner*—Paul R Durand
(74) *Attorney, Agent, or Firm*—William J. Sapone; Coleman Sudol Sapone P.C.

(57) ABSTRACT

In a device with a plurality of holding units, each holding unit has a leading prong and a rear prong resiliently kept closed for holding a box in vertical orientation. The holding units are arranged spaced out on an operating group for intermittent motion through work stations for inserting products into the boxes. The rear prong can be moved away from the leading prong by a catching pawl for introducing a box into the opened holding unit, at an inlet station, and for removing the box in a discharge station, situated downstream. This avoids rubbing between the prongs and the box walls that could damage the precious ornamental patterns applied to the box.

16 Claims, 9 Drawing Sheets

11
123
210
14
23
160
121
120
122
210
21
22
15

RA
1
W
24
20
P
RR
IV
11
13A
161
IV
14A
α
13
14
H1
H2
III
12
16
160
23
12
III
10
162
210
21
22
23

DEVICE FOR GRIPPING AND TRANSFERRING ARTICLES, IN PARTICULAR BOXES

BACKGROUND OF THE INVENTION

The invention relates to automatic machines for packaging articles into boxes.

Said boxes are usually made of cardboard or paperboard and are arranged, in a flat folded configuration, in a magazine of the machine, from which they are picked up one by one and erected.

In particular, the invention relates to the operation group aimed at receiving the erected boxes and at conveying them through various stations, in which articles, possible additional elements, are introduced therein, and then the boxes are closed to be delivered in a zone corresponding to a discharge station.

DESCRIPTION OF THE PRIOR ART

In the technical field concerned, there are many known solutions for manufacturing the above mentioned gripping and transport group, each of which has specific characteristics that make it more suitable for certain uses rather than for others.

Many of these known solutions have elements, aimed at defining a plurality of housings, or box-like containers, or the like, each of which has dimensions allowing to contain a determined box size, with practically no clearance, so as to ensure a certain position of the open side of the same box, through which the article is to be introduced.

Due to this, the box walls touching said elements are subjected to rubbing during the initial step, when the box is introduced into the housing, as well as during the final step, when it is discharged.

In many cases, this is not a problem, since the surface of the walls concerned do not have writings or printings, and in any case, if there are any, they are made with such a technique, as not to be damaged even in case of slight rubbing.

In the high level cosmetics and perfumery, the box has particular ornamental patterns on its outer walls, such as lacquering, embossing and others, that make the surfaces extremely delicate.

It is not tolerable that such precious boxes are damaged due to rubbing during the introduction into the gripping and transport group or during the discharge thereof.

It is very often essential, in this specific field, that the box be arranged in the holding unit in a vertical orientation, with the article introduction side turned upwards, since the article itself has such a shape that the upright position is the only stable one.

SUMMARY OF THE INVENTION

Therefore, the object of the present invention is to propose a device for gripping and transferring articles, in particular boxes, shaped in such a way, as to protect the integrity of the box walls, even with particularly delicate ornamental patterns.

Another object of the present invention is to propose a device, that is capable of being adjusted to fit the size, to suit the box dimensions included in a prefixed range.

A still further object of the invention is to propose a device that not only fulfills the previous objects, but is also particularly indicated for machines with vertical top loading.

A further object of the invention is to propose a device, shaped in such a way as not to occupy the spaces above and below the box with positive effect on the operation of the other means and members present in various work stations of the machine, provided with the proposed device.

The above mentioned object, as well as many others which will be more apparent in the following, are obtained by means of a device for gripping and transferring articles, in particular boxes, the device being mounted on a packaging machine including:

- a magazine, situated upstream of said gripping and transferring device for containing flat folded blanks;
- picking up means for picking up single blanks and erecting them, so as to form boxes;
- work stations, situated along said gripping and transferring device and having respective means for introducing articles and possible additional elements into each box, and for closing the heads of the boxes;
- with said gripping and transferring device including:
- a plurality of holding units for receiving and holding said boxes;
- each holding unit including a leading prong and a rear prong;
- a conveyor, following a close-loop path extending between an inlet station, situated in a position corresponding to said means for erecting the boxes, and a discharge station, situated downstream, in a position corresponding to an outlet line of the same boxes, with each holding unit being fastened to said conveyor;
- an operating group for stepwise motion of said conveyor along said path in a forward direction;
- elastic closing means for each holding unit for keeping the holding unit in a closed position with said prongs so spaced apart as to fit longitudinal dimension of the boxes and hold the boxes along the active run of said path through said work stations;
- first opening means, situated in said inlet station and acting on said elastic closing means to open said prongs up to a distance bigger than said longitudinal dimension of said boxes;
- loading means, provided in said inlet station for picking up said boxes one by one from by said erecting means and for introducing the boxes into corresponding holding units, in time relation with dwell and opening of the holding units, without contact between the boxes and the prongs;
- second opening means, provided in said discharge station, for acting on said elastic closing means to open said prongs and move away the prongs from respective walls of said boxes;
- ejection means, provided in said discharge station for moving said boxes out of the respective holding units, in time relation with dwell and opening of the holding units, without contact between the boxes and the prongs, and to said outlet line.

BRIEF DESCRIPTION OF THE DRAWINGS

The characteristic features of the invention will become evident from the following description of a preferred embodiment of the proposed device, in accordance with the contents of the claims and with help of the enclosed Figures, in which:

DISCLOSURE OF THE PREFERRED EMBODIMENTS

Figure 1A:
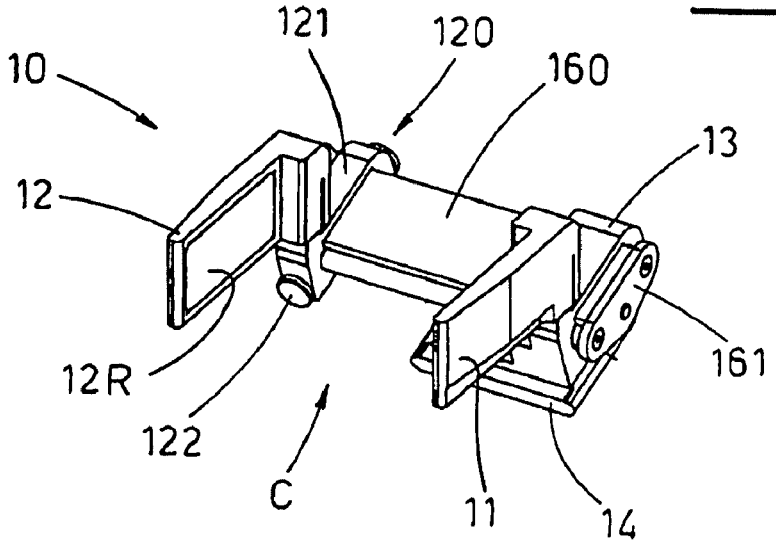
FIG. 1A is a perspective view of a holding unit of the device.

Having regard to the above mentioned Figures, the reference numeral 1 indicates the proposed gripping and transferring device, as a whole.

The device 1 is associated, for example, to a packaging machine M for introducing articles into boxes 2.

The machine M, of substantially known type and therefore not shown completely, is known as "vertical machine", due to the fact that the boxes 2 are arranged in vertical orientation, with the article introduction side turned upwards.

This configuration of the machine is preferred, when the article shape does not allow a stable position different from the upright one; this happens often, for example for high level cosmetics and perfumery products.

The machine M includes, situated upstream of the device 1, a magazine not shown for containing flat folded blanks F, with means 3 working below to pick up said blanks F one by one.

Figure 6:
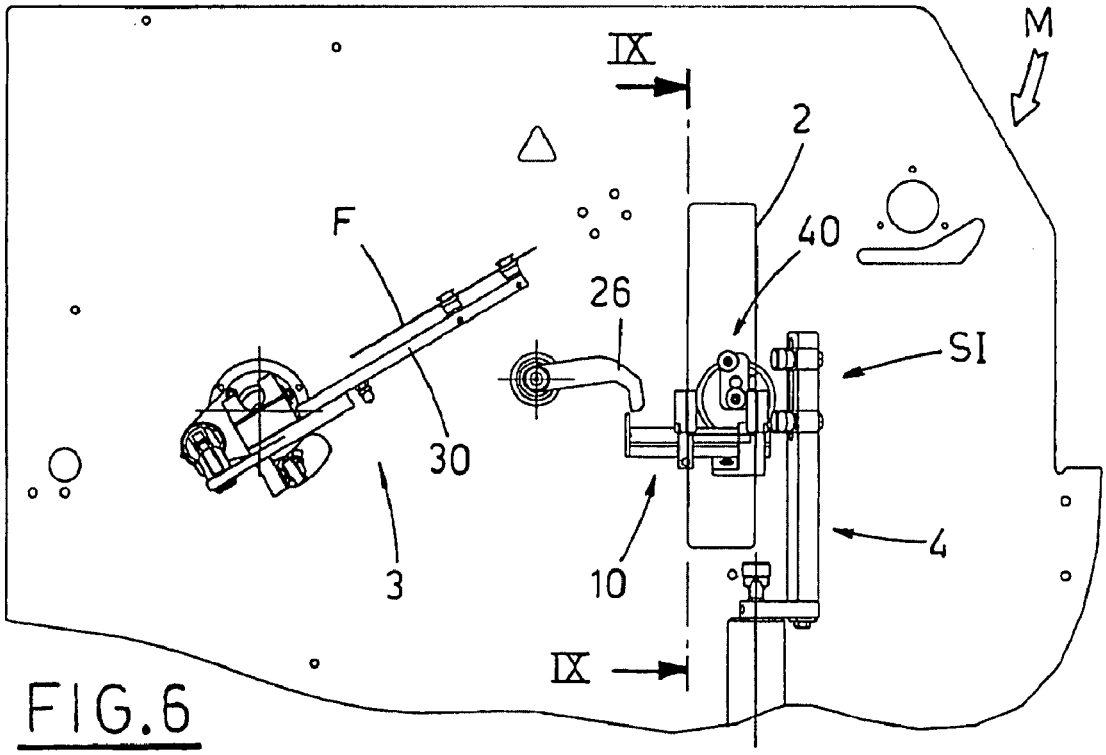
FIG. 6 shows a portion of a boxing machine, in which the initial part of the device of FIG. 2 is situated.
Figure 7:
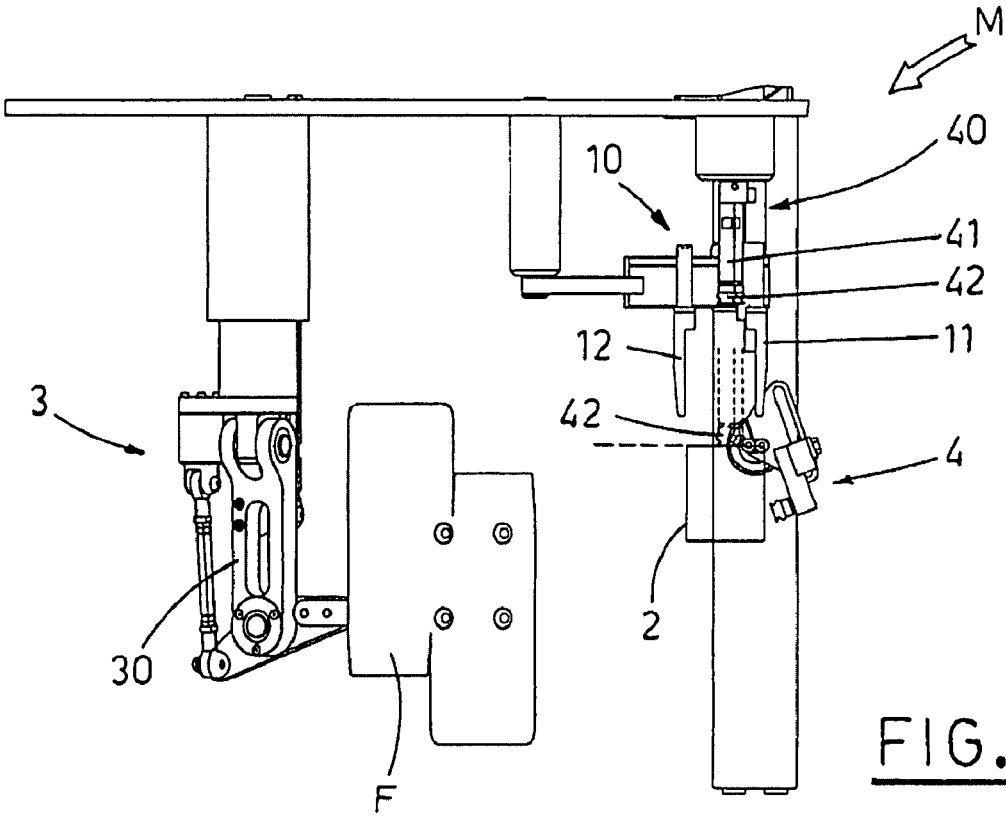
FIG. 7 is a plan view of the boxing machine as shown in FIG. 6.
Figure 8:
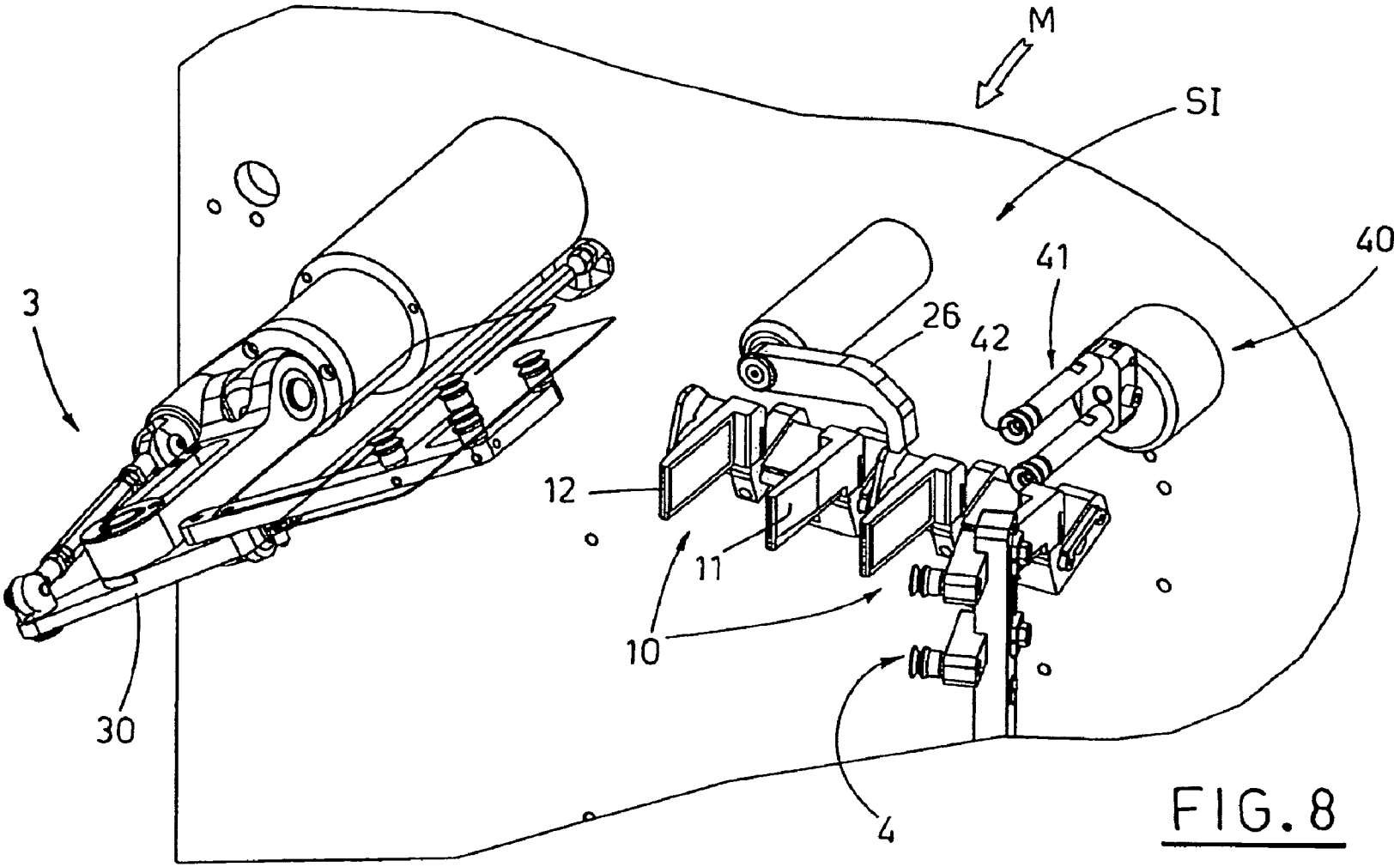
FIG. 8 is a perspective view of the same portion of FIG. 6.

The means 3, shown in FIGS. 6, 7, 8 are, for example, similar to what has been described in the Italian Patent Application number B02006A000123, filed by the same Applicant. The means 3 include a rototranslating arm 30, capable of picking up a blank F from the magazine bottom, arranging it on a horizontal plane, so as to transfer it later outside of the space occupied by the same magazine, rotating it in the meanwhile, so as to present it in vertical orientation, to deliver it to the erecting means 4, which are aimed at erecting the same blank F in order to define a corresponding box 2.

Figure 16:
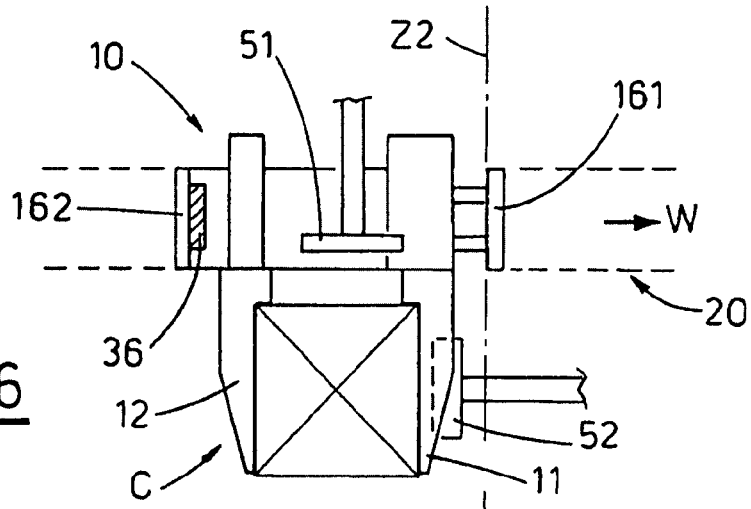
FIGS. 16, 17, 18 are plan views of subsequent steps when the box is discharged from the holding unit.
Figure 17:
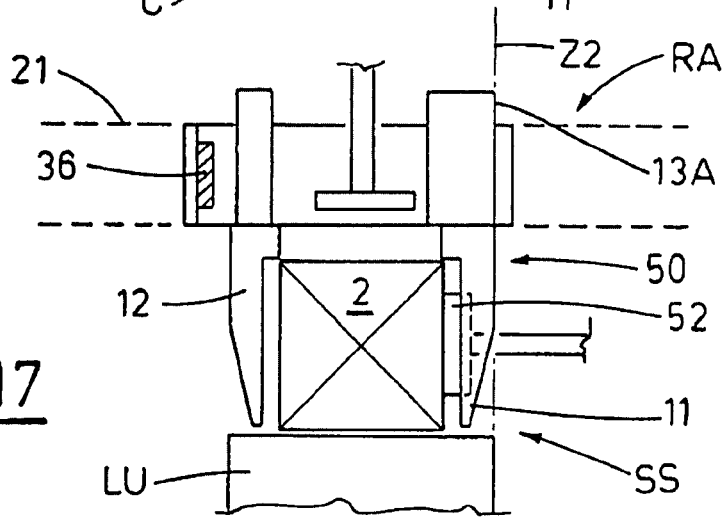
Figure 18:
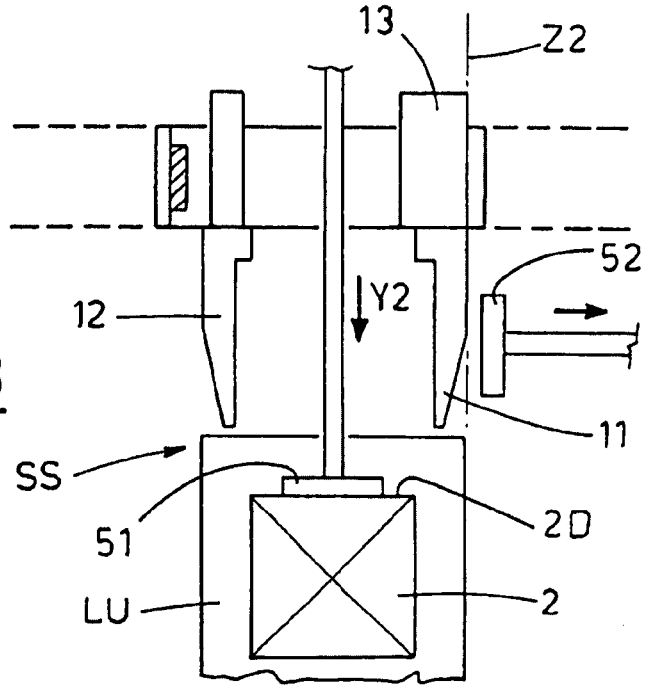

The erecting means 4, of known type, for example provided with suction cups, are arranged in an inlet station SI, situated in a zone corresponding to the initial part of the device 1, which, according to the invention, includes a plurality of holding units 10, arranged stepwise along a close-loop path P, extending between the inlet station SI FIG. 8 and a discharge station SS, situated downstream, in a zone corresponding to an outlet line LU of the same boxes 2 See FIGS. 16-18.

The holding units 10 are associated to an operating group 20, aimed at determining a stepwise forward movement of the units 10 along said path P, in which an upper active run RA and a lower return run RR are defined.

Figures 2, 3:
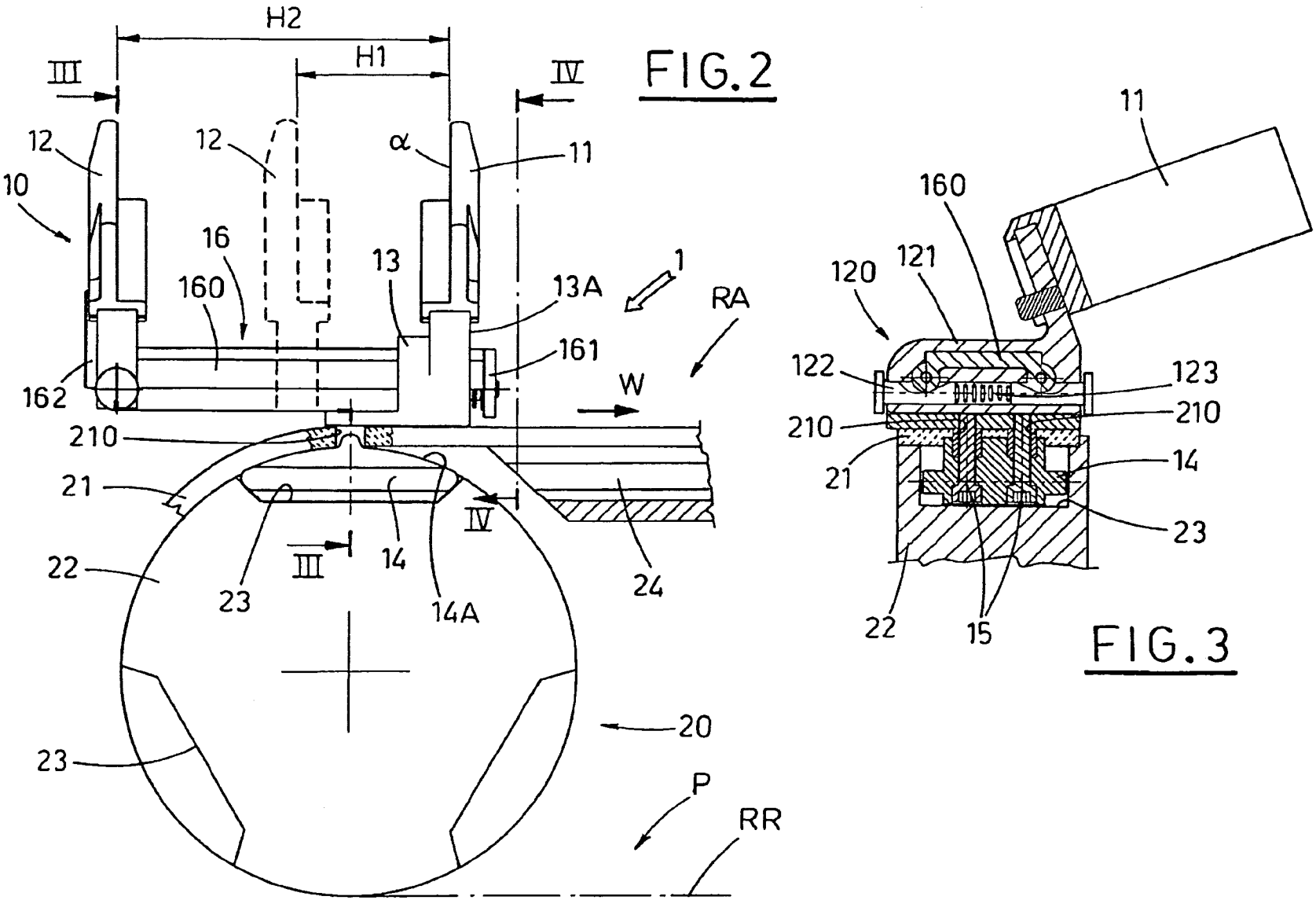
FIG. 2 is a lateral, partial view of the device.
FIG. 3 is a section view, taken along the plane III-III of FIG. 2.
Figure 4:
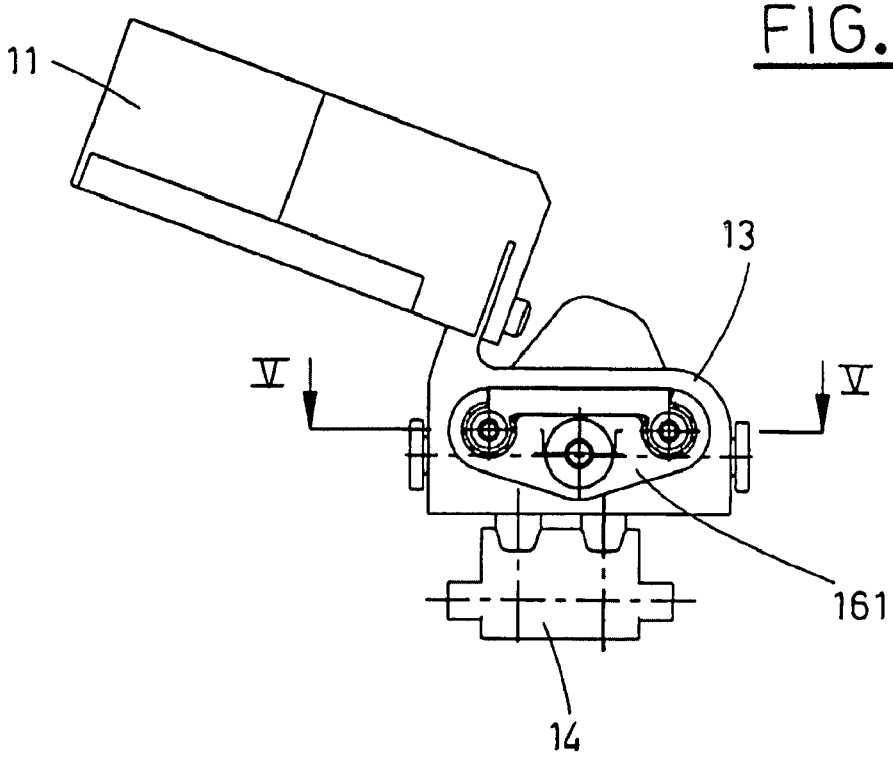
FIG. 4 is a section view, taken along the plane IV-IV of FIG. 2.

The operating group 20 includes a belt 21, which has holding units 10, fastened thereto, and which is mounted on a pair of relative pulleys, a driving pulley not shown and a driven pulley 22, respectively. The pulleys are operated by motor means, likewise not shown, in a direction W, in time relation with the remaining operation means of the machine M (FIGS. 2 and 3).

Figure 14:
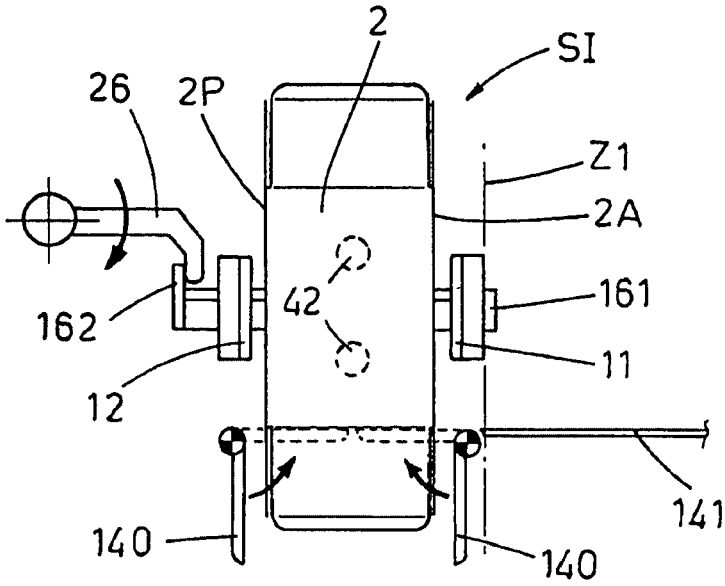
FIG. 14 is a view along the arrow X of FIG. 13 of the same operation step, shown in the latter.
Figure 13:
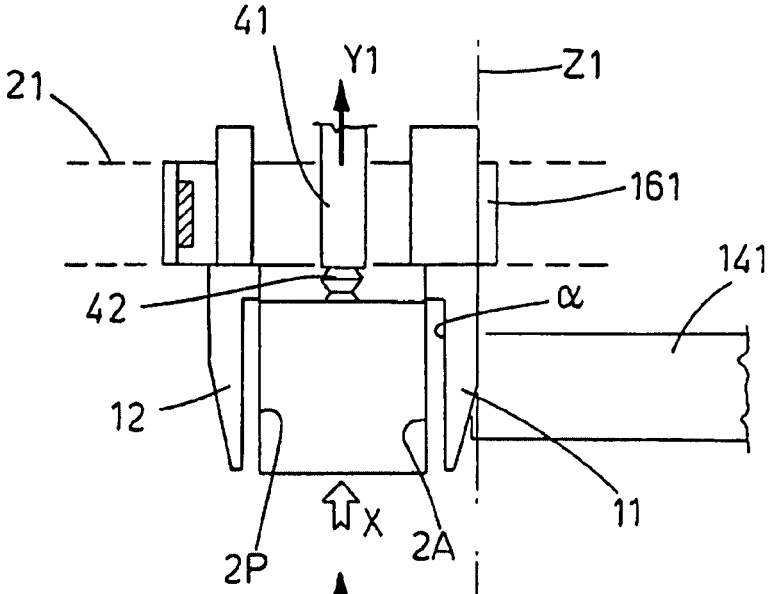
Figure 15:
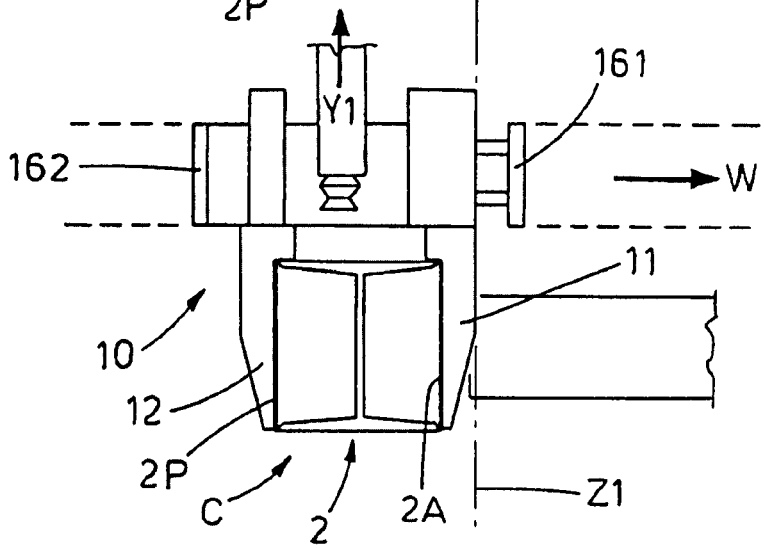
FIG. 15 shows the step, in which the box is engaged by the holding unit.

Each holding unit 10 is aimed at receiving and holding one of the boxes 2 along the section corresponding to the upper active run RA and includes a leading prong 11 and a rear prong 12, intended for going in abutment against the box 2 vertical walls, respectively a leading wall 2A and a rear wall 2P, arranged transversely with respect to the forward movement direction W, as better specified later on (FIGS. 13-15).

Figure 1B:
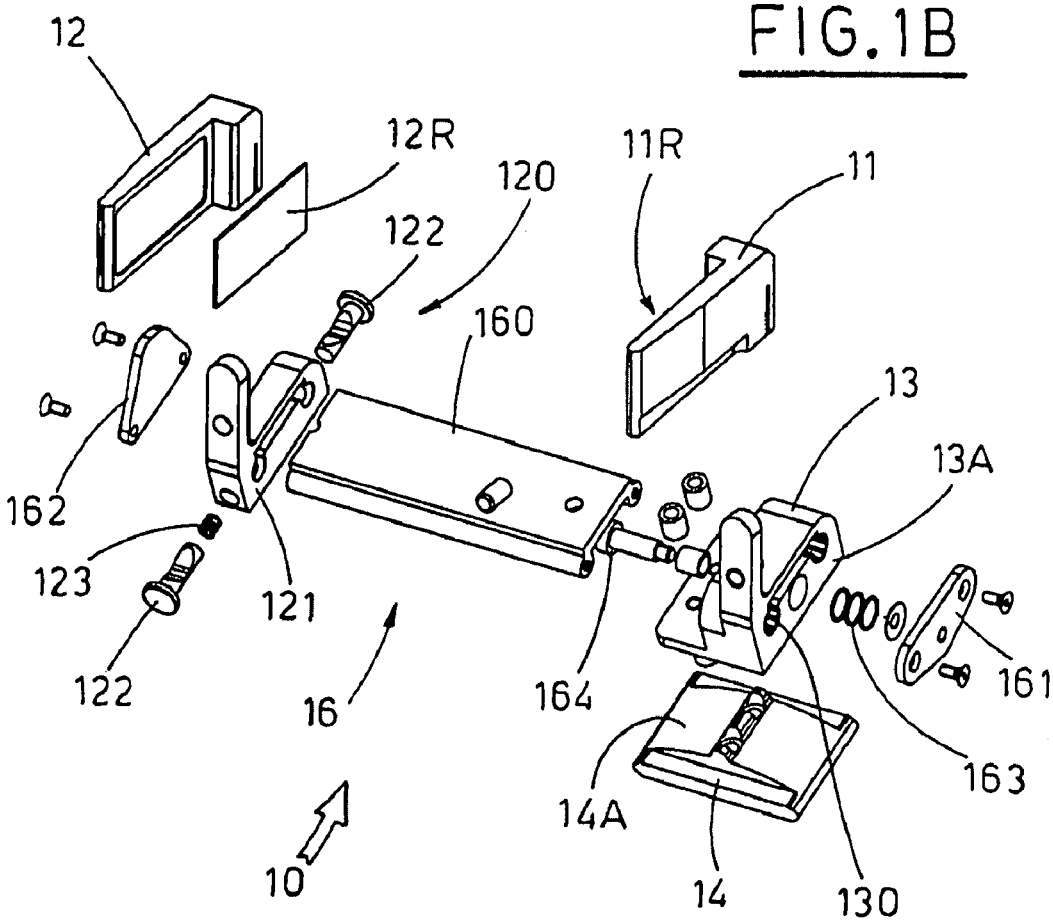
FIG. 1B is a perspective, exploded view of the unit of FIG. 1A.

The prongs 11, 12, on their inner side turned toward the walls 2A, 2P of the box 2, have advantageously respective coverings 11R, 12R, of soft material having high friction coefficient, for example bouncing putty or the like (FIG. 1B).

According to a preferred constructive solution, the rotation axis A of the driving and driven pulleys is inclined with respect to the horizontal, so that the upper active run RA is offset outward of the machine M with respect to the return run RR. Due to this contrivance and with a suitable orientation of the prongs 11, 12, a free space is obtained, below the boxes 2 introduced into the units 10, particularly advantageous for housing and operating the mechanisms (not shown), aimed at closing the lower heads of the boxes 2 (see in particular FIG. 9).

The leading prong 11, stationary with respect to the belt, is made integral with the upper part of a hearing block 13, which has also a base block 14, fastened to the lower part of the bearing block by screw means 15 (FIGS. 1A, 1B, 2, 3, 4).

Figure 9:
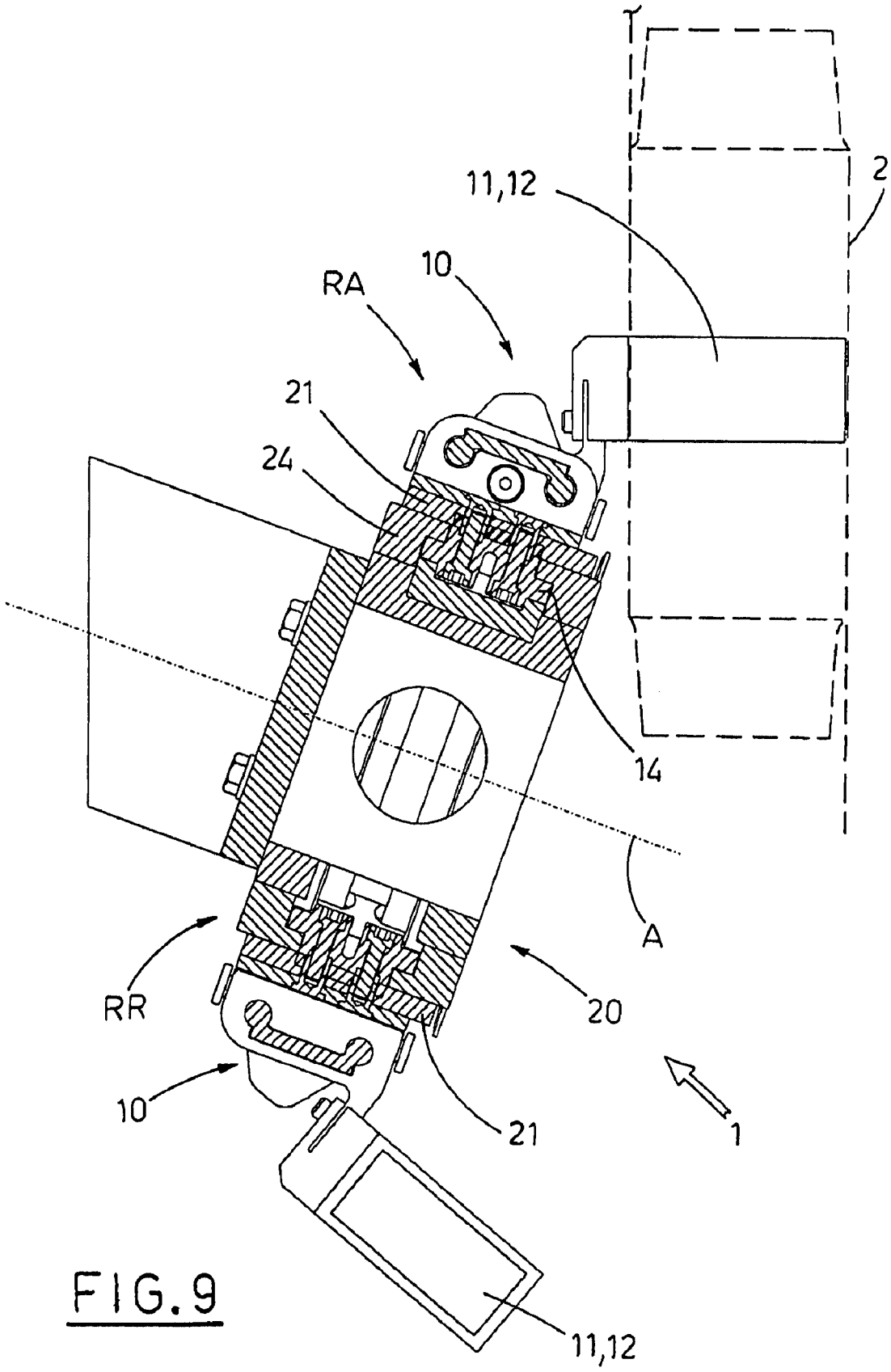
FIG. 9 is a vertical section view of the device.

The belt 21, interposed and clamped between the bearing block 13 and the base block 14, is suitably provided with slots 210, aimed at allowing the screw means 15 to pass (FIGS. 2, 3, 9).

The upper surface 14A of the base block 14, turned toward the belt 21, has a curved shape, whose radius is equal to the one between the driving and driven pulleys 22. The latter have, on their relative circumference, recesses 23, angularly spaced apart, according to the step of the holding units 10, aimed at housing said base blocks 14, which consequently keep a matching engagement between the belt 21 and of the pulleys, similarly to a toothed coupling (FIGS. 2 and 3).

A grooved guide 24, made in the upper active run RA of the path P, is aimed at being engaged by the base block 14, so as to stabilize the straight extension of the run RA.

The rear prong 12, which is movable with respect to the belt, is associated to elastic closing means 16, supported by the bearing block 13 and aimed at holding the relevant holding unit 10 in a closed position C, in which the prongs 11, 12 are so spaced apart as to fit the longitudinal dimension of the boxes 2.

The elastic closing means 16 include, in the given example, a carriage 160, engaged slidably with a complementary seat 130, made in the bearing block 13, and having integral therewith, at the extremities, two plates 161, 162, a leading plate and a rear plate respectively.

Figure 5:
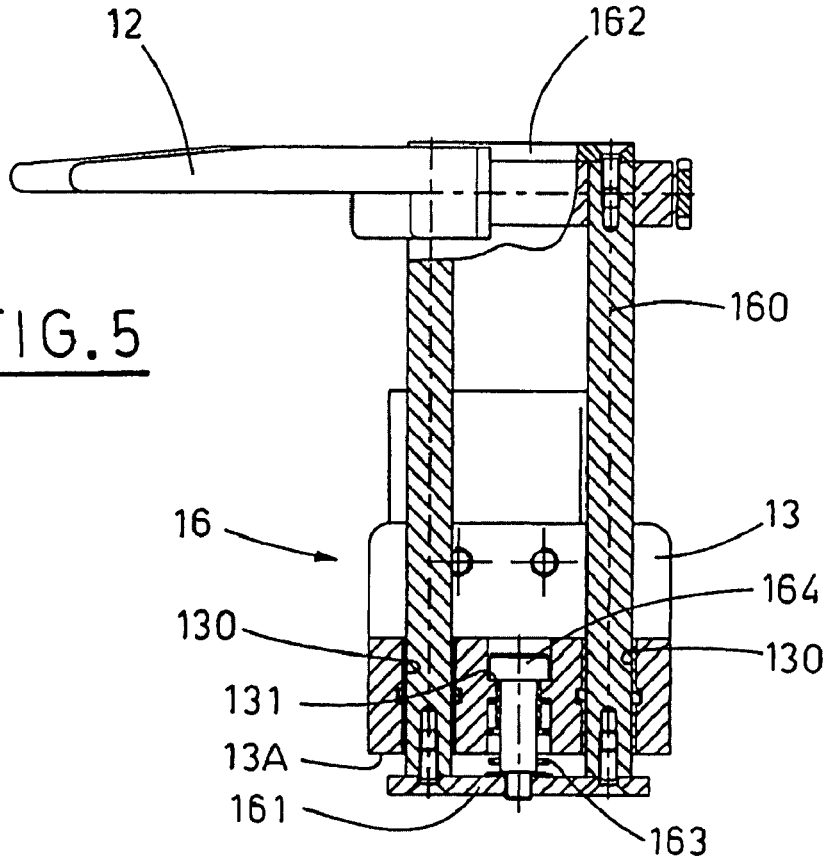
FIG. 5 is a section view, taken along the plane V-V of FIG. 4.

The carriage 160 is subjected to the action of a spring 163, aimed at pushing a stop 164, made in the same carriage 160, in abutment against a rest 131, made in the block 13 (FIGS. 1B and 5).

When in the closed position C, the leading plate 161 is situated at a selected distance from the corresponding upstream wall 13A of the block 13; with this distance defining the maximum excursion of the carriage 160 in the direction of the rear prong 12 away movement, with respect to the leading prong 11, whose function will become clearer in the following.

According to the preferred embodiment, shown in the Figures, the rear prong 12 is connected to the carriage 160 by adjusting means 120, which allow changing the distance between the rear prong 12 and the leading prong 11, within a prefixed range from a minimum distance HI up to a maximum distance H2, in relation to the corresponding longitudinal dimension of the boxes 2 (FIG. 2).

As it is obvious from what has just been said, the size is adjusted in relation to a fixed reference a situated upstream with respect to the forward movement direction, contrary to the usual practice, which considered instead the downstream fixed reference; this aspect becomes advantageous for the purposes of the invention objects, as explained in the following.

The adjusting means 120 include, e.g. a slide 121, with which the rear prong 12 is made integral, and which is fitted slidably on the carriage 160, and which has a brake 122, constantly locked due to the action of the elastic means 123 and aimed at stabilizing the desired position of the slide 121 according to the boxes 2 size (FIGS. 1B and 3).

The brake 122 can be unlocked from outside, to modify the position of the slide 121 and of the attached rear prong 12, during the size changeover.

This last mentioned operation can be carried out manually, by an operator, on a plurality of the holding units 10, with help of a suitable template, or a suitable automatic mechanisms, properly situated on the machine.

The device 1 includes also first opening means 26, situated in the inlet station SI, outside of the holding units 10 and of the relative operating group 20, and aimed at acting on the elastic closing means 16 to cause the rear prong 12 move away from the leading prong 11, as much as allowed by the carriage 160 motion.

The first opening means 26 include, for example, an oscillating pawl, aimed at catching the rear plate 162, suitably advanced in time with respect to the stopping of the corresponding holding unit 10 at the inlet station SI (FIGS. 6, 7, 8), as better explained in the following description of the device operation.

Loading means 40, also provided in the inlet station SI, are aimed at picking up the boxes 2 by the erecting means 4 and at introducing them into corresponding holding units 10, dwelling in the inlet station SI, in time relation with the opening of the prongs 11, 12.

The loading means 40 include, for example, a head 41, provided with suction cups 42 (FIGS. 6, 7, 8), which move in a horizontal direction Y1, perpendicular to the forward movement direction W, between a fore position (broken line in FIG. 7), in which a box 2 is picked up, a rear position, in which the box just picked up is introduced into the unit 10, and a rest position, out of the space occupied by the latter.

In the discharge station SS there are second opening means 36, wholly identical with the above mentioned first means 26 (seen only partially in FIGS. 16, 17, 18), and ejection means 50, aimed at pushing the box 2 out from the holding units 10, in time relation with the opening of the prongs 11, 12, in a horizontal direction Y2, perpendicular to the forward movement direction W, and at moving the same box 2 to the outlet line.

The ejection means 50 include, for example, a pushing member operated in the direction Y2, helped by a moving abutment operated parallel to the forward movement direction W and aimed at intercepting the leading wall 2A of the box 2.

Figure 10:
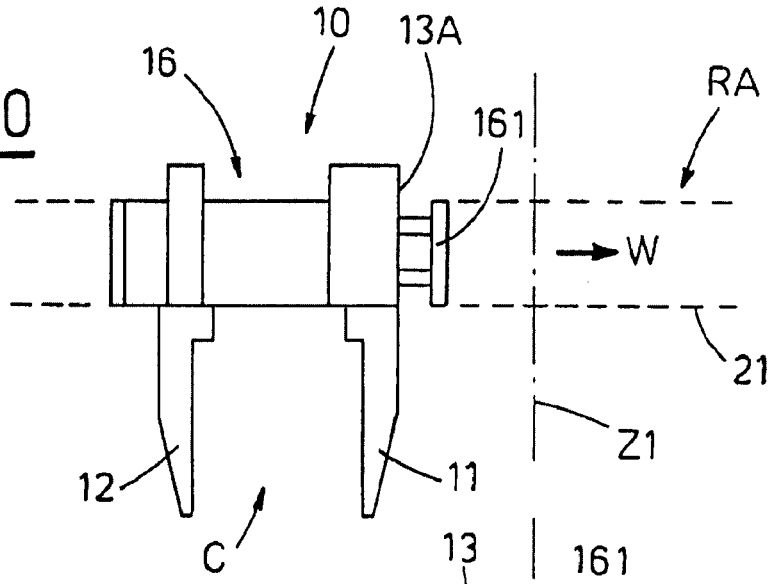
FIGS. 10, 11, 12, 13 are plan views of subsequent steps of the introduction of a box into a holding unit of the device.

Now, operation of the device will be described, beginning from the arrival at the inlet station SI of a holding unit 10 in close position C (FIG. 10).

For sake of clarity, FIG. 10 and the subsequent ones up to FIG. 15, indicate a dot-and-dash line Z1, which represents the stop position which the leading wall 13A of the bearing block 13 must reach, when the operating group 20 stops for a rest.

Figure 11:
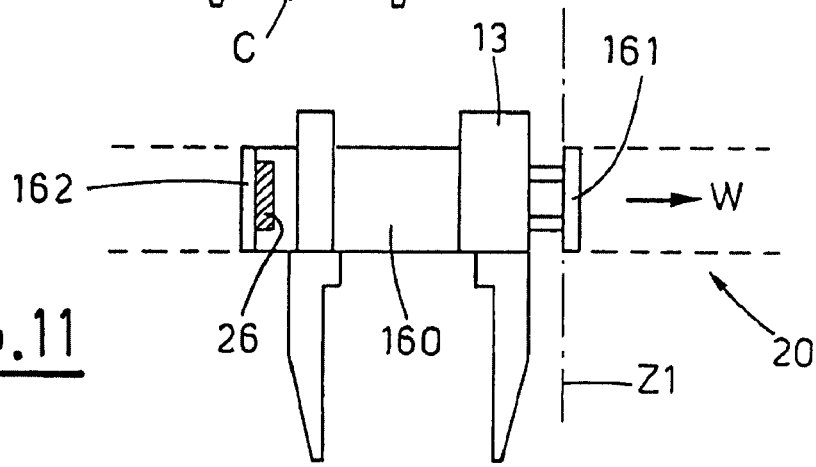

FIG. 11 shows the moment, in which the leading plate 161 has overcome the stop position Z1 by a distance equal to its thickness; the oscillating pawl 26 (seen only partially) is lowered in time relation to catch the rear plate 162, so as to stop the forward movement of the carriage 160 and of the attached rear prong 12, while the leading prong 11, integral with the bearing block 13 and consequently with the belt 21, continues together with the latter.

Figure 12:
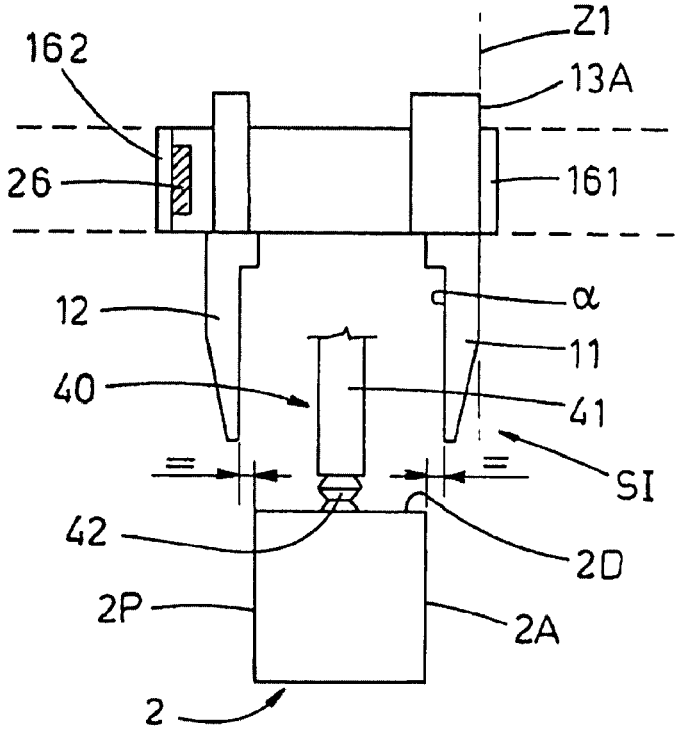

That is allowed by compression of the spring 163 and by the distance, separating the leading wall 13A of the block 13 from the leading plate 161; the remaining part of the movement further carried out by the block 13 before the stop, causes the reduction and then zeroing of this distance, so that the leading plate 161 goes so far as to touch the leading wall 13A (FIG. 12).

Therefore, in this situation, the prongs 11, 12 are mutually spaced apart by a distance given by the adjustment to a size to fit the longitudinal dimension of the box 2, plus the preexisting space between the leading plate 161 and the leading wall 13A; for indication, this space is of about 4 mm.

Meanwhile, the box 2 is erected by the erecting means 4, immediately outside the prongs 11, 12, centered with respect thereto, so that the dimensional difference is subdivided evenly both upstream and downstream (see FIG. 12).

The fixed reference $\alpha$ of the holding unit 10, which is, as it has already been said, situated upstream, is in a more advanced position with respect to a corresponding reference defined by the leading wall 2A of the box 2, engaged with the erecting means 4.

At this point, the box 2 is delivered to the loading means 40, with the head 41 carried in its forward position, in which the suction cups 42 goes in contact with the corresponding longitudinal wall 2D of the box 2 (see again FIG. 12 and also FIG. 7).

The head 41 is carried to its backward position, which results in the introduction of the box 2 between the prongs 11, 12, still spaced apart by the corresponding leading wall 2A and rear wall 2P (FIG. 13).

Folding means 140, present in the inlet station SI below the box 2, are operated, before the head 41 withdraws further to the rest position, leaving the box 2, so as to fold the lower transversal flaps of the latter and to create a continuity with a consecutive support plane 141, which extends parallel to the active run RA (FIG. 14).

This operation is necessary to support the box 2 during the passage between the release by the suction cups 42 and the gripping between the prongs 11, 12, which cannot occur before the release, due to the offset position of the fixed reference a of the holding unit 10 with respect to the fixed reference of the box 2, which would cause the deformation of the box.

FIG. 15 shows the phase, in which the head 41 has returned to the rest position and the oscillating pawl 26 has released the rear plate 162, allowing the spring 163 to withdraw the carriage 160 and consequently also the rear prong 12, which contacts the corresponding rear wall 2P and pushes forward the box 2; the stop 164 abuts against the rest 131 simultaneously with the contact of the leading prong 11 on the leading wall 2A; at this point the box 2 is held by the prongs 11, 12 and the fixed reference a coincides with the fixed reference of the holding unit 10.

The subsequent forward stepwise movements of the holding unit 10 and of the associated box 2 carry the latter through different work stations of the machine M, not shown as known and not relevant to the invention, placed along the upper active run RA, aimed at introducing, into each box, a corresponding article, as well as possible additional elements, such as stabilizing inserts, strengthening elements, leaflets, etc.

In subsequent work stations, likewise not shown, suitable means close the heads of the box 2, before it arrives at the discharge station SS.

During all the above mentioned operations, the integrity of the ornamental patterns present on the box 2 walls, even particularly delicate, is protected by the presence of the coverings 11R, 12R of the prongs 11, 12.

FIGS. 16, 17, 18, related to the discharge station SS, indicate a dot-and-dash line Z2, which, similarly to what has been said in connection with the previous Figures, represents the end position, which the leading wall 13A of the bearing block 13 must reach, when the operating group 20 stops for a rest.

FIG. 16 shows the step corresponding to the one already described in connection to FIG. 11, with the oscillating pawl of the second opening means 36 catching the rear plate 162; at the same time, the moving abutment 52 is in its working position, at a distance from the leading wall 2A of the box 2 which, in the illustrated moment, equals more or less to a half of the already mentioned distance between the rear plate 162 and the leading wall 13A of the bearing block 13.

With the operation analogous to the one already described in relation to FIG. 12, the rear prong 12 stops its motion, when the front one continues up to the stop position of the operating group 20; during this step, when the prongs 11, 12 begin to move away from each other, the box 2 continues its run due to inertia, resting on the support plane 141 (not shown here), until it goes to contact the moving abutment 52, that stops it.

At this point, it is important to point out the advantage given by the choice of the fixed reference a, which allows to move the box 2 away from both prongs, by a simple interposition of the moving abutment 52.

When the holding unit 10 is stopped, with the prongs 11, 12 spaced apart, the box 2 is moved away therefrom, nearly symmetrically, upstream and downstream (FIG. 17).

In time relation, first the moving abutment 52 is moved away and then the pushing member 51 is operated, pushing the longitudinal wall 2D of the box 2 to cause the latter to leave the holding unit 10 and to move it to the outlet line LU, oriented perpendicular to the active run RA.

It is very important to point out that the box outlet translation occurs without any rubbing against the prongs, like in the opposite inlet translation described previously and also in all the operations performed by device 1.

This way of operation, peculiar to the proposed device 1, allows to manipulate the boxes with absolute security of not damaging their aesthetic patterns on the walls, even if very delicate.

This feature makes the device particularly suitable for the fields, like high level cosmetics and perfumery, which need such a certainty; obviously, the device as conceived, can result suitable also for other applications, which require the handling of delicate articles, that cannot be subjected to surface rubbing.

Another advantage of the device relates to its facility of adjustment to size, which, even if carried out manually, requires extremely reduced machine downtime and, with the adjusting means 120 shaped like described, does not require any tools.

Another advantage of the device lies in the arrangement of operating group with inclined axis, which leaves a lot of space below the boxes for their closing.

Obviously, if the device is used for handling other articles, that are not so demanding, the operating group can be arranged even with the horizontal axis.

Apart from the inclination of the operating group axis, the device is shaped in such a way, as to leave completely free the upper part of the box, for the benefit of the means present in various work stations.

Moreover, the technical solutions used in the proposed device assure the maximum movements precision and a high operation reliability, so as to minimize the jamming risks.

However, it is understood that what above is a pure, not limiting example, therefore possible detail changes, applied to the described means for constructive and/or functional reasons, remain within the protection scope defined by the claims below.

What is claimed is:

1. A device for gripping and transferring articles, in particular boxes, the device being mounted on a packaging machine including:

a magazine, situated upstream of said gripping and transferring device for containing flat folded blanks;

picking up means for picking up single blanks and erecting them, so as to form boxes;

work stations, situated along said gripping and transferring device and having respective means for introducing articles and possible additional elements into each box, and for closing the heads of the boxes;

with said gripping and transferring device including:

a plurality of holding units for receiving and holding said boxes;

each holding unit including a leading prong and a rear prong;

a conveyor, following a close-loop path extending between an inlet station, situated in a position corresponding to said means for erecting the boxes, and a discharge station, situated downstream, in a position corresponding to an outlet line of the same boxes, with each holding unit being fastened to said conveyor;

an operating group for stepwise motion of said conveyor along said path in a forward direction;

elastic closing means for each holding unit for keeping the holding unit in a closed position with said prongs so spaced apart as to fit longitudinal dimension of the boxes and hold the boxes along the active run of said path through said work stations;

first opening means, situated in said inlet station and acting on said elastic closing means to open said prongs up to a distance bigger than said longitudinal dimension of said boxes;

loading means, provided in said inlet station for picking up said boxes one by one from by said erecting means and for introducing the boxes into corresponding holding units, in time relation with dwell and opening of the holding units, without contact between the boxes and the prongs;

second opening means, provided in said discharge station, for acting on said elastic closing means to open said prongs and move away the prongs from respective walls of said boxes;

ejection means, provided in said discharge station for moving said boxes out of the respective holding units, in time relation with dwell and opening of the holding units, without contact between the boxes and the prongs, and to said outlet line, wherein in each holding unit the leading prong is made integral with a bearing block and has a fixed position, while the rear prong is connected to said elastic closing means and is movable toward said leading prong, due to the action of the closing means, and away from the leading prong due to the action of said first and second opening means, and, wherein said elastic closing means include a carriage, carrying said rear prong, engaged slidably with a complementary seat, made in said bearing block, with said carriage having at the extremities, two plates, namely a leading plate and a rear plate integral with said carriage ad located at opposed extremities of the carriage, with a stop made in the same carriage and subjected to the action of the elastic means for pushing the stop against an abutment, made in said bearing block, to define said closed position of the holding unit with said leading plate placed at a prefixed distance from the corresponding leading wall of said block, with said distance corresponding to the maximum stroke of said carriage in direction of movement of the rear prong away from said leading prong.

2. A device, according to claim 1, wherein said leading prong and said rear prong go in abutment against the leading wall and rear wall of a box, respectively, arranged transversely with respect to said forward movement direction.

3. A device, according to claim 1, wherein said prongs (11, 12) on the side turned toward the walls (2A, 2P) of said box (2), have respective coverings (11R, 12R), of soft material having high friction coefficient.

4. A device, according to claim 1, wherein said rear prong is connected to said elastic closing means by adjusting means, which allow changing the distance between the rear prong and the leading prong, within a prefixed range between a minimum value and a maximum value, in relation to said longitudinal dimension of the boxes and in relation to a fixed reference (a), defined upstream with respect to said forward movement direction.

5. A device, according to claim 4, wherein said adjusting means include a slide, carrying said rear prong made integral and fitted slidably on said carriage, the slide having a brake, constantly locked due to the action of the elastic means for stabilizing a prefixed position of the slide according to the boxes size.

6. A device, according to claim 5, wherein said brake can be unlocked from outside manually, for size change operations.

7. A device, according to claim 5, wherein said brake can be unlocked from outside by automatic mechanisms, provided in said machine, for size changeover operations.

8. A device, according to claim 1, wherein said first opening means include an oscillating pawl, which catches a rear plate made in said elastic closing means, in phase advance with respect to stopping of a holding unit in said inlet station, to determine the stop of said rear prong and the consequent moving of the rear prong away from said leading prong.

9. A device, according to claim 1, wherein said loading means include a head, provided with suction cups, which move in a horizontal direction, perpendicular to said forward movement direction, between a fore position, in which said box is picked up by said erecting means, and a rear position, in which said box is introduced into the holding unit, dwelling in said inlet station, and a rest position, out of the space occupied by the holding unit.

10. A device, according to claim 1, wherein said second opening means include an oscillating pawl, which catches a rear plate made in said elastic closing means, in phase advance with respect to the stopping of the corresponding holding unit in said discharge station, to determine the stop of said rear prong and the consequent moving of the latter away from said leading prong.

11. A device, according to claim 1, wherein said ejection means include a pushing member, operated in a horizontal direction, perpendicular to said forward movement direction, and a moving abutment, operated parallel to said forward movement, to intercept the leading wall of said box, in time relation with the operation of said second opening means, and to move it away from the leading prong, with the same moving abutment moved away from said leading wall in time advance with respect to the operation of said pushing member for the discharge of the box.

12. A device for gripping and transferring articles, in particular boxes, the device being mounted on a packaging machine including:

a magazine, situated upstream of said gripping and transferring device for containing flat folded blanks;

picking up means for picking up single blanks and erecting them, so as to form boxes;

work stations, situated along said gripping and transferring device and having respective means for introducing articles and possible additional elements into each box, and for closing the heads of the boxes;

with said gripping and transferring device including:

a plurality of holding units for receiving and holding said boxes;

each holding unit including a leading prong and a rear prong;

a conveyor, following a close-loon path extending between an inlet station,. situated in a position corresponding to said means for erecting the boxes, and a discharge station, situated downstream, in a position corresponding to an outlet line of the same boxes, with each holding unit being fastened to said conveyor;

an operating group for stepwise motion of said conveyor along said path in a forward direction;

elastic closing means for each holding unit for keeping the holding unit in a closed position with said prongs so spaced apart as to fit longitudinal dimension of the boxes and hold the boxes along the active run of said path through said work stations;

first opening means, situated in said inlet station and acting on said elastic closing means to open said prongs up to a distance bigger than said longitudinal dimension of said boxes;

loading means, provided in said inlet station for picking up said boxes one by one from by said erecting means and for introducing the boxes into corresponding holding units, in time relation with dwell and opening of the holding units, without contact between the boxes and the prongs;

second opening means, provided in said discharge station, for acting on said elastic closing means to open said prongs and move away the prongs from respective walls of said boxes;

ejection means, provided in said discharge station for moving said boxes out of the respective holding units, in time relation with dwell and opening of the holding units, without contact between the boxes and the prongs, and to said outlet line; wherein said operating group includes a belt mounted on a pair of pulleys, namely a driving pulley and a driven pulley operated by motor means to move the belt in said forward movement direction, with said holding units fastened to said belt, said belt forming an upper active run for said holding units to convey said boxes, and a lower return run, and wherein said driving and driven pulleys of said operating group have rotation axis inclined with respect to the horizontal, so that said active run is offset outwards of said machine with respect to the return one.

13. A device, according to claim 12, wherein said belt is interposed and clamped, in a position corresponding to each of said holding units, between a bearing block, made in the latter, and a base block, fastened to the lower part of the same bearing block by screw means, which pass through corresponding slots, made in the same belt.

14. A device, according to claim 13, wherein said base blocks have a related upper surface, turned toward said belt shaped with a curved profile with radius equal to the radius of the driving and driven pulleys, on which the belt is mounted.

15. A device, according to claim 13, wherein said base blocks engage with recesses, made externally in said driving and driven pulleys, to lock the phase between said belt and said pulleys.

16. A device, according to claim 13, wherein said base blocks engage with a grooved guide, made in the active run, covered by said belt.

* * * * *